US005358609A

United States Patent [19]

Drackett

[11] Patent Number: 5,358,609

[45] Date of Patent: Oct. 25, 1994

[54] ELECTROLYTIC PRODUCTION OF HYDROGEN PEROXIDE USING BIPOLAR MEMBRANES

[75] Inventor: Thomas S. Drackett, Vancouver, Canada

[73] Assignee: Chemetics International Company Ltd., Vancouver, Canada

[21] Appl. No.: 10,006

[22] Filed: Jan. 27, 1993

[30] Foreign Application Priority Data

Dec. 4, 1992 [GB] United Kingdom ..... 9225421.8

[51] Int. Cl.[5] ..... C25B 1/30

[52] U.S. Cl. ..... 204/84; 204/101; 204/129

[58] Field of Search ..... 204/84, 129, 258, 256, 204/265, 266, 263, 257, 255, 101; C25B 1/30, 9/00

[56] References Cited

U.S. PATENT DOCUMENTS

| | | | |
|---|---|---|---|
| 4,384,931 | 5/1983 | Jasinski et al. | 204/84 |
| 4,950,368 | 8/1990 | Weinberg et al. | 204/72 |
| 4,969,981 | 11/1990 | Rogers et al. | 204/84 |
| 5,006,211 | 4/1991 | Paleoiogou et al. | 204/182.4 |

OTHER PUBLICATIONS

SRI International, Report No. 68B, Mar. 1992—Y-u—Ren Chin.

"The Use of Gas Diffusion Electrodes in the On-Site Generation of Oxidants and Reductants"—Fifth International Forum on Electrolysis in the Chemical Industry Sponsored by the Electrosynthesis Company, Inc., Nov. 10-14, 1991, Fort Lauderdale, Fla., P. C. Foller et al.

*Primary Examiner*—Kathryn Gorgos

*Attorney, Agent, or Firm*—Cushman, Darby & Cushman

[57] ABSTRACT

A method and apparatus for producing hydrogen peroxide in caustic solution utilizing an electrolytic cell having electrolytes, preferably, alkaline in both anode and cathode compartments separated by a bipolar membrane which splits water into hydrogen ions and hydroxyl ions. Electrolysis of oxygen which diffuses through a gas-diffusion cathode forms peroxide in catholyte while hydrogen ions generated within the bipolar membrane migrate into the catholyte. Peroxide can be produced in the catholyte as a cell product having a caustic to peroxide ratio of less than 1.0 at five percent peroxide, by weight.

7 Claims, 3 Drawing Sheets

ELECTROLYTIC PRODUCTION OF HYDROGEN PEROXIDE USING BIPOLAR MEMBRANES

FIELD OF THE INVENTION

This invention relates to the electrolytic production of hydrogen peroxide, per salts and the like in alkaline solutions.

BACKGROUND TO THE INVENTION

Commercial production of hydrogen peroxide in significant quantities has been performed using, mainly, one of three processes, viz:

i ) the formation of barium peroxide from the oxide heated in oxygen followed by acid dissolution yielding hydrogen peroxide;

ii) the electrolytic anodic oxidation of sulphuric acid or its salts to peroxydisulphates which hydrolyze to yield hydrogen peroxide; and iii) the cyclical catalytic oxidation then reduction of organics, typically anthraquinone.

Although another process route for the production of hydrogen peroxide, viz, by the cathodic reduction of oxygen has been known for some time, such a process has only recently been utilized commercially for producing hydrogen peroxide solutions. The first of the commercial processes listed above is labour intensive and no longer of importance. The second process has high energy demand and, thus, led to the commercialisation of much lower energy demand anthraquinone processes. Anthraquinone processes usually produce solutions containing 70 to 90% hydrogen peroxide by weight which reduces transportation and storage costs; this is important since the complexity of these processes results in relatively high capital and maintenance costs which favour large production merchant plants. The theoretically low energy demand cathodic oxygen reduction process has received considerable attention recently, especially as the art of making gas-diffusion cathodes suitable for hydrogen peroxide production has progressed; this electrochemical route is potentially very simple to operate although the product is so far only a dilute caustic peroxide solution.

Dilute caustic peroxide solutions are particularly suitable for use in the wood pulp bleaching industry. In addition to the bleaching of woodpulp, alkaline solutions of hydrogen peroxide are suitable for other bleaching applications and chemical bleaching operations. Electrochemically produced hydrogen peroxide in low concentrations may be used without further concentration in such bleaching operations, and hence, on-site electrochemical hydrogen peroxide production has been contemplated for supplying hydrogen peroxide at wood pulp plants for bleaching.

Several approaches have been patented for the electrolytic production of hydrogen peroxide by cathodic reduction of oxygen. Yu-Ren Chin (SRI International, Report No. 68B, March 1992) summarizes the most important patents and presents economic comparisons between anthraquinone processes commercialised and cathodic oxygen reduction process. However, a major disadvantage of the presented methods of electrolytic preparation of alkaline peroxide solutions is that the inherent caustic to peroxide ratio (by mole) is larger than 2, which limits its end use applications.

In fact, in a typical electrochemical cell for the production of hydrogen peroxide in an alkaline electrolyte such as sodium hydroxide, the cathode reaction yields:

$$H_2O+O_2+2Na^++2e\rightarrow NaOH+NaHO_2 \quad (1)$$

Hence, it is evident that the minimum molar ratio of sodium ion to peroxide is 2.

Jasinski and Kuehn (U.S. Pat. No. 4,384,931; May 24, 1983) recognised the advantage, for lower caustic peroxide ratios, of an acidic anolyte. They describe an electrolytic cell having two electrolytes, one acidic, one alkaline, separated by a membrane permeable to positive ions (cation selective membrane). An acidic aqueous anolyte is introduced between an acid resistant anode and the cation selective membrane; an alkaline aqueous catholyte is introduced between a gas-diffusion cathode and the membrane; and an oxygen containing gas is introduced to the outside of the gas-diffusion cathode. Water in the acidic anolyte is electrolysed to form oxygen, hydrogen ions and electrons:

$$2H_2O\rightarrow O_2+4H^++4e^- \quad (2)$$

Electrical neutrality requires that the hydrogen ions ($H^+$) migrate toward the cathode through the cationic selective membrane and into the catholyte.

At the cathode, oxygen diffuses through the gas-diffusion cathode and reacts with the hydrogen ions ($H^+$) migrating through the membrane from the anolyte and with sodium ions present in the catholyte to form sodium hydroxide and hydrogen peroxide by either of the reactions:

$$2H_2O+2O_2+2H^++2Na^++4e\rightarrow 2NaOH+2H_2O_2 \quad (3)$$

$$3/2O_2+3H^++Na^++4e\rightarrow NaOH+H_2O_2 \quad (4)$$

However, the hydrogen ions ($H^+$) migrating into the catholyte also neutralizes caustic as caused by the reaction;

$$NaOH+H^+\rightarrow H_2O+Na^+ \quad (5)$$

Equations (3), (4) and (5) lower the caustic to peroxide ratio below 1.0 since the sodium ion of equation (5) again reacts to produce more peroxide. However, some of the disadvantages of the electrolytic cell with acidic anolyte may be listed as follows:

i) a greater degree of complexity in the process due to differing electrolytes;

ii) a requirement for acid resistant materials including anodes, gaskets, and other cell components; these materials can be much more expensive than materials suitable for an alkaline electrolyte; and, iii) a higher energy demand compared to alkaline anolyte cells by nature of acidic solutions in electrolytic cells.

Bipolar membranes are composite membranes consisting of three parts, a cation selective region, an anion selective region and the interface between the two regions. When a direct current is passed across a bipolar membrane with the cation selective side toward the cathode, electrical conduction is achieved by the transport of $H^+$ and $OH^-$ ions which are obtained from the dissociation of water which occurs at the interface under the influence of an electric field. Bipolar membranes are described, for example, in U.S. Pat. No. 2,829,095 to Oda et al, in U.S. Pat. No. 4,024,043 (single film bipolar membranes), and in U.S. Pat. No. 4,116,889 (cast bipolar membranes).

Paleologou and Berry (U.S. Pat. No. 5,006,211; Apr. 9, 1991) applied electrodialysis with bipolar membranes to the dealkalization of caustic peroxide solutions such as those produced by the reduction of oxygen in electrolytic cells (e.g. the Dow on-site peroxide generator, U.S. Pat. Nos. 4,224,129 and 4,317,704). Two compartment unit cells (alternating cation and bipolar membranes) and three compartment unit cells (alternating bipolar, anion, and cation membranes) are described for the dealkalization of typical 2:1 caustic/peroxide solutions with the co-production of a caustic solution suitable for recycle to the peroxide generator.

The disadvantage of the electrodialysis approach for dealkalization of a generated alkaline peroxide solution is the addition of another process system to an on-site electrolytic peroxide production plant; overall capital cost will be higher for the generating electrolysis system plus electrodialysis system, the overall energy demand will be higher in spite of the good efficiency of typical electrodialysis systems, and the increased number of equipment items will necessarily increase manpower requirements for operations and maintenance.

The most commonly referenced applications involving bipolar membranes are generally of the electrodialytic type, although direct electrolytic application is known. However, a bipolar membrane could not be used in every type of electrolytic cell such as those peroxide generators which rely on flow of alkaline anolyte through a porous diaphragm into the cathode chamber which is filled with composite carbon chips as a high surface area cathode; a bipolar membrane would not simply replace the porous diaphragm which is also of a special structure to ensure an even flow distribution to the cathode bed. Since such a peroxide generator is the only commercialised electrolytic cell, for cathodic reduction of oxygen to produce hydrogen peroxide, and since bipolar membranes are most generally associated with electrodialytic type applications, then the use of bipolar membranes in the electrolytic production of hydrogen peroxide by the cathodic reduction of oxygen is not readily apparent.

SUMMARY OF THE INVENTION

It is an object of the present invention to provide methods and apparatus suitable for producing hydrogen peroxide in an on-site location which can produce hydrogen peroxide in aqueous, preferably, alkaline solution having caustic to peroxide ratios suitable for direct use in the pulp bleaching industry and providing more flexibility for end use applications.

In accordance with one aspect of the present invention, there is provided a method for producing hydrogen peroxide comprising the steps of:

(a) introducing an aqueous anolyte between an anode and an anion permselective membrane surface of a bipolar membrane;

(b) introducing an aqueous catholyte between a cation permselective membrane surface of a bipolar membrane and a first surface on a gas-diffusion cathode;

(c) introducing oxygen-containing gas to a second surface on said gas-diffusion cathode;

(d) connecting said acid resistant anode and said gas diffusion cathode with an external power supply for causing:

(i) the oxygen to be reduced at said gas-diffusion diffusion cathode to produce $O_2H-$ ions within said aqueous catholyte, (ii) the hydroxyl $OH^-$ ions in said alkaline aqueous anolyte to be oxidized to produce oxygen and water within said aqueous anolyte (iii) water in said bipolar membrane to be dissociated into hydrogen ions $H+$ and hydroxyl $OH-$ ions;

(iv) said dissociation produced $OH-$ ions to move through the anion selective surface of said bipolar membrane to the aqueous anolyte whereupon said $OH-$ ions maintain electroneutrality by replacing anodically oxidized $OH-$ ions of said aqueous anolyte, and (v) said dissociation produced hydrogen ions $H+$, to move through the cation selective surface of said bipolar membrane to the aqueous catholyte whereupon said hydrogen ions $H+$ react with the cathodically produced $O_2H^-$ ions to produce hydrogen peroxide within said aqueous catholyte.

The dissociated water in the bipolar membrane is replenished by water migrating from the aqueous electrolytic solutions.

Most preferably, the aqueous anolyte and aqueous catholyte are alkaline.

Particularly, the method is useful for producing a solution comprising sodium hydroxide and hydrogen peroxide wherein the anode comprises alkali resistant steel, nickel or other alkali resistant electroconductive material suitable for the anodic oxidization of water; the cathode comprises graphitized carbon black or carbon particles with polytetrafluoroethylene (PFTE) (TEFLON) binding agent (e.g. Lindstrom et al, U.S. Pat. Nos. 4,647,359 and 4,248,682) prepared according to the art to be suitable for the production of $O_2H-$ ions by the cathodic reduction of oxygen; the alkaline aqueous anolyte comprises a sodium hydroxide solution and the alkaline aqueous catholyte comprises a sodium hydroxide solution.

In a further feature, the invention provides apparatus for producing hydrogen peroxide comprising a water-oxidizing anode; a gas-diffusion cathode; a bipolar, water-dissociating membrane disposed between said water-oxidizing anode and said gas-diffusion cathode; means for passing an aqueous, preferably, alkaline anolyte between the water-oxidizing anode and the anion selective surface on the bipolar membrane; means for passing an aqueous, preferably, alkaline catholyte between the cation selective surface on the bipolar membrane and a first surface on the gas-diffusion cathode; means for introducing an oxygen-containing gas to a second surface on a said gas-diffusion cathode; and, means for connecting said water-oxidizing anode and said gas-diffusion cathode with an external power supply for causing, (i) the oxygen to be reduced at said diffusion cathode to produce $HO_2-$ ions within said aqueous catholyte, (ii) the hydroxyl $OH-$ ions in said aqueous anolyte to be oxidized to produce oxygen and water within said aqueous anolyte, (iii) the water in said bipolar membrane to be dissociated into hydrogen ions $H+$ and hydroxyl $OH-$ ions, (iv) the dissociation produced $OH-$ ions, to move through the anion selective surface of said bipolar membrane to the aqueous anolyte whereupon said OH− ions maintain electroneutrality by replacing anodically oxidized OH− ions of said aqueous anolyte, and (v) the dissociation produced hydrogen ions (H+), to move through the cation selective surface of said bipolar membrane to the aqueous catholyte whereupon said hydrogen ions (H+) react with the cathodically produced $HO_2$− ions to produce hydrogen peroxide within said aqueous catholyte.

In yet a further aspect, the invention provides monopolar cells for producing hydrogen peroxide comprising a plurality of electrolytic cells in monopolar arrangement having two-sided anodes and two-sided cathodes forming anode and cathode compartments on either side of each with alkaline aqueous anolyte and alkaline aqueous catholyte therein separated by said bipolar membranes between the alternating anodes and cathodes.

In a still yet further aspect, the invention provides bipolar cells for producing hydrogen peroxide comprising a plurality of electrolytic cells in bipolar arrangement having said bipolar electrode elements comprised of an anode surface electrically connected to said gas diffusion cathode and forming anode and cathode compartments on either side of each with said alkaline aqueous anolyte and said alkaline aqueous catholyte therein separated by said bipolar membranes between said bipolar electrode elements.

BRIEF DESCRIPTION OF THE DRAWINGS

In order that the invention may be better understood, preferred embodiments will now be described by way of example only, with reference to the accompanying drawings wherein.

DESCRIPTION OF THE PREFERRED EMBODIMENTS

Figure 1:
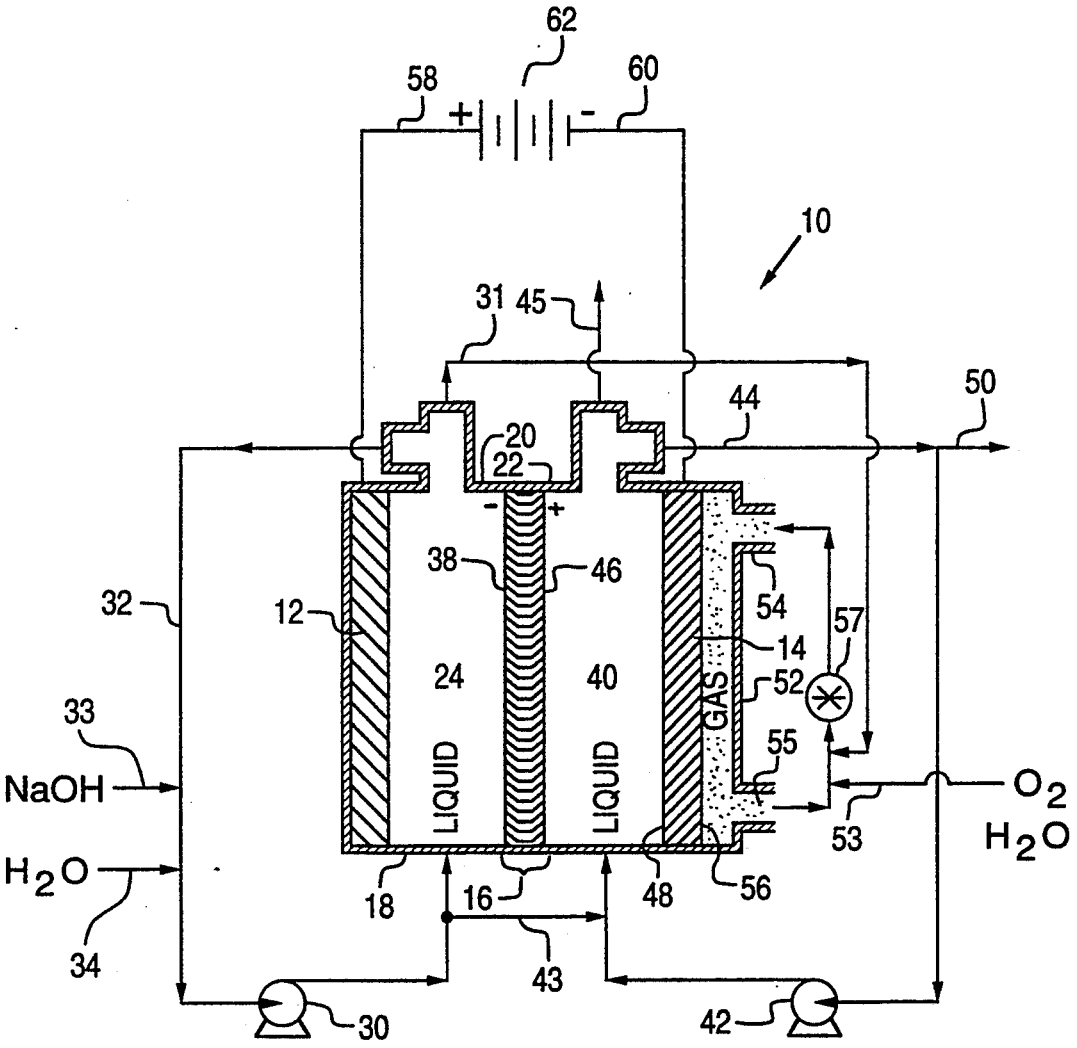
FIG. 1 is a diagrammatic drawing showing apparatus and a method for producing hydrogen peroxide utilizing an electrolytic cell having an anode and a cathode compartment with an alkaline aqueous anolyte and an alkaline aqueous catholyte therein separated by a bipolar membrane.

With specific reference to FIG. 1, there is generally shown apparatus 10 for producing hydrogen peroxide in a sodium hydroxide solution which includes an anode 12, cathode 14, and a bipolar membrane 16 disposed therebetween, all within an outside shell, or casing, 18 to form an anode compartment 20 and a cathode compartment 22.

It is to be appreciated that although a rectangular configuration of the apparatus is illustrated in FIG. 1, the actual shape of the anode cathode membrane and overall cell may be of any suitable shape which provides a relationship between the anode 12 cathode 14 and bipolar membrane 16 as depicted in the schematic FIG. 1. Further, the figure also serves as a flow diagram for the method of the present invention.

The anode 12 may be any dimensionally stable anode (DSA) which is stable, or resistant, to aqueous sodium hydroxide solution. Examples of anode material include stainless steel, nickel, or commercially available DSA materials such as platinum/iridium metals or their oxides or combinations thereof coated on niobium. The alkaline aqueous anolyte 24, such as, sodium or other alkali metal hydroxide solution, may be circulated through the anode compartment 20 by a pump 30 via lines 32 and water may be added as needed, to the anolyte 24 to replenish water which is dissociated by the bipolar membrane 16, by means of a line 34.

As the alkaline aqueous anolyte is circulated, or passed, through the anode compartment 20, it contacts the water-oxidizing anode 12 and the anion selective surface 38 of the bipolar membrane 16, being of, for example, but not limited to the type having an amine-crosslinked polystyrene-vinylbenzyl chloride anion layer prepared in accordance with U.S. Pat. No. 4,116,889 to Chlanda et al. As will be hereinafter discussed in greater detail, the bipolar membrane 16 dissociates water which enables passage of hydrogen ions (H+) through the cation selective membrane surface 46 into an alkaline aqueous catholyte 40 contained in the cathode compartment 22, but prevents the passage of anions in the catholyte from entering the anode compartment 20 and anolyte 24, and which enables passage of OH− ions through the anion selective membrane surface 38 into an alkaline aqueous anolyte 24 contained in the anode compartment 20, but prevents the passage of cations (e.g. Na+ cations) in the anolyte from entering the cathode compartment 22 and catholyte 40. Further, oxygen produced at the anode 12 by the oxidation of hydroxyl ions (OH−) can be recovered via line 31 to the gas-diffusion cathode and additional oxygen or oxygen containing gas can be supplied via the inlet line 53.

A second pump 42 and line 44 provides a means for passing the alkaline aqueous catholyte 40 such as an aqueous sodium hydroxide solution, through the cathode compartment 22 and in contact with the cation selective surface 46 on the bipolar membrane 16 and a first surface 48 on the gas-diffusion cathode 14. As hereinafter discussed in greater detail, hydrogen peroxide is formed within the catholyte and when the concentration thereof reaches a pre-selected level, product may be withdrawn from the catholyte compartment 26 via an output line 50.

Alternatively, a once though passage of aqueous sodium hydroxide solution (albeit at lower flowrate) through the cathode compartment 22 can be done to obtain a product solution directly.

In either case of catholyte flow (circulating or once through), a means of replenishing the alkaline catholyte which is associated with the product exiting via output line 50 is required. A feed stream of the aqueous sodium hydroxide solution can be obtained from an independent source or, as is shown in FIG. 1, can be obtained as a exit stream from the circulating alkaline aqueous anolyte via the interconnecting line 43. Subsequently, the aqueous sodium hydroxide solution comprising the alkaline aqueous anolyte is replenished by an addition of aqueous sodium hydroxide via the inlet line 33.

The latter source of make-up solution to the catholyte is a favorable alternative when hydrogen peroxide is the desired product of a simple process system. The use of the same electrolyte in both anode and cathode compartments reduces the process complexity; however, to reduce power consumption, an optimized process should consider the use of a more conductive alkaline electrolyte for the anolyte and the alkaline catholyte could remain as an aqueous sodium hydroxide solution. Further, the alkaline catholyte could be chosen from aqueous solutions of salts such as sodium carbonate or sodium borate which would form persalts such as sodium percarbonate or sodium perborate.

The cathode 14 preferably is a planar gas-diffusion type, well known in the art, having a porous structure enabling passage of oxygen gas therethrough. A chamber 52 having an inlet 54 therein provides a means for introducing either substantially pure oxygen gas or an oxygen containing gas, such as air, to a second surface 56 on the gas-diffusion cathode 14.

Gas diffusion cathodes suitable for the production of hydrogen peroxide by the cathodic reduction of oxygen are discussed in the literature (Balej, J. et al; Chem. svesti. vol. 30 No. 3, pp. 384–392; 1976) and described by patents granted to various workers such as Grangaard (U.S. Pat. No. 3,459,652; Aug. 5, 1969). Another porous carbon electrode is described by Lindstrom (U.S. Pat. No. 4,647,359; Mar. 3, 1987) and by Lindstrom et al (U.S. Pat. No. 4,248,682; Feb. 3, 1981); these patents are referenced in a publication which discusses the production of hydrogen peroxide (P. C. Foller, R. J. Allen, R. T. Bombard, and R. Vora; "The Use of Gas Diffusion Electrodes in the On-Site Generation of Oxidants and Reductants"; Fifth International Forum on Electrolysis in the Chemical Industry; Nov. 10–14, 1991), although the inclusion of noble metal for catalysis in the cathodic reduction of oxygen to produce hydrogen peroxide is likely to be unnecessary.

It is to be appreciated that the present invention is not limited by the materials of, or the manner in which, the gas-diffusion cathode is constructed provided that the cathode is suitable for the production of hydrogen peroxide by the cathodic reduction of oxygen and that the cathode can be used in the arrangement of anode cathode and membrane as generally described herein.

Also, other types of oxygen reduction cathodes may be used as would be evident to those skilled in the art. For example, Oloman and Watkinson (J. Appl. Electrochem. vol. 9, 1979, pp. 117–123) describe "tricke-bed" electrochemical reactors having a thin packed cathode bed of graphite particles, and disclose in U.S. Pat. No. 3,969,201 the use of a cation selective membrane as a barrier wall separating the anode from the packed cathode bed; the cation selective membrane can be replaced with a bipolar membrane.

Oxygen gas or air supplied to the gas-diffusion cathode could vary in the method and/or conditions for optimum operation according to instructions given by the maker of the gas-diffusion cathode. In FIG. 1 a circulation of gas through the chamber 52 adjacent to the second surface 56 on the gas-diffusion cathode 14 is shown with a fan or compressor 57 passing gas to the inlet 54 of the chamber 52 and receiving gas from the chamber via the outlet 55. Further, oxygen produced at the anode 12 by the oxidation of hydroxyl ions (OH−) can be recovered via line 31 to the gas-diffusion cathode and additional oxygen or oxygen containing gas can be supplied via the inlet line 53. Also, optimum operation of a gas-diffusion cathode may require the addition of water to maintain a specified concentration of moisture in the gas.

The present invention is not limited by the manner in which oxygen is supplied to the gas-diffusion cathode since the method suggested by the schematic of FIG. 1 is an illustrative example only; a simpler single inlet of gas to the chamber 52 may suffice, for example, for laboratory work.

Provision is also shown in the schematic of FIG. 1 for venting of gas from the catholyte via line 45.

The anode may also be of the gas-diffusion type and may be described similarly to the gas-diffusion cathode except that the gas diffusion anode would be polarized positively and fed with hydrogen gas resulting in a reduced cell voltage and subsequently reduced power consumption.

Electrical lines 58, 60 provide a means for connecting the alkali resistant anode 12 and the gas-diffusion cathode 14 respectively, with an external power supply 62 for causing oxygen which is introduced to the second surface of the gas-diffusion cathode to be reduced at the gas-diffusion cathode first surface 48 after diffusion into the cathode to produce OH− and $O_2H$− ions within the basic aqueous catholyte.

In addition, interconnection of the anode 12 and the cathode 14 with the power supply 60 causes hydroxyl ions (OH−) in the alkaline aqueous anolyte to be oxidized to produce oxygen, water and electrons within the alkaline aqueous anolyte in the anode compartment 20. Further, the electric field established between the anode and the cathode 14 by the external power supply 62 causes the dissociation of water in the bipolar membrane 16, causes the dissociation-produced hydrogen ions to move through the cation selective membrane surface 46 into the alkaline aqueous catholyte 40 whereupon the hydrogen ions react with the OH− and $HO_2$− ions to produce hydrogen peroxide and water within the alkaline aqueous catholyte and causes the dissociation-produced hydroxyl ions (OH−) to move through the anion selective membrane surface 38 into the alkaline aqueous anolyte to replenish those hydroxyl ions (OH−) in the alkaline aqueous anolyte which have been oxidized.

The schematic of FIG. 1 represents a simplified process flowsheet for the invention and a completely designed system, as prepared by one skilled in the art, would include equipment items such as tanks and heat exchangers. Accordingly, the schematic of FIG. 1 is not to be considered limiting to the present invention.

In operation, hydroxyl ions (OH−) in the anolyte 24 are electrolyzed to form oxygen, water and electrons, $$4OH^- \rightarrow O_2 + 2H_2O + 4e^- \quad (6)$$

As electron flow is from the anode to the cathode, electrical neutrality requires that the alkali metal cations (e.g. sodium cations Na+) leave the anolyte or that anions enter into the anolyte 24. Since the surface 38 of the bipolar membrane 16 is permeable to negative ions only, hydroxyl ions (OH−) migrate toward the anode 12 through the anion selective surface 38 of the bipolar membrane 16 and into the anolyte 40.

The reaction of equation (6) occurs in alkaline solution instead of the reaction of equation (2) which occurs in acidic solution and there is a voltage saving of about 0.8 volts in the cell of the present invention due to this difference.

In the bipolar membrane 16, water dissociates to form hydrogen ions (H+) and hydroxyl ions (OH−), $$H_2O \rightarrow H^+ + OH^- \quad (7)$$

As the hydroxyl ions (OH−) migrate through the anion selective membrane surface 38 into the anolyte 24, electrical neutrality is maintained by the migration of the hydrogen ions (H+) toward the cathode through the cation selective surface 46 of the bipolar membrane and into the catholyte 40. The water which is dissociated in the bipolar membrane 16 is replenished by diffusion of water from either or both of the aqueous electrolyte solutions.

At the cathode, oxygen diffuses through the cathode 14 and reacts with the hydrogen ions (H+) migrating through the cation selective surface 46 of the bipolar membrane 16 and sodium ions present in the catholyte 40 to form sodium hydroxide and hydrogen peroxide as shown by the reaction of equation (3), and at high current densities the cathode reaction may be as given by equation (4).

It is evident that the ratio of caustic to peroxide produced by the reactions (3) and (4) is 1.0, however, the hydrogen ions (H+) migrating into the catholyte cause the reaction of equation (5). This lowers the caustic to peroxide ratio below 1.0 since the sodium ion again reacts in accordance with equation (3) and (4) to produce more peroxide.

Acid is not consumed in the present method because the hydrogen ions (H+) are produced by dissociation of water in the bipolar membrane.

Figure 2:
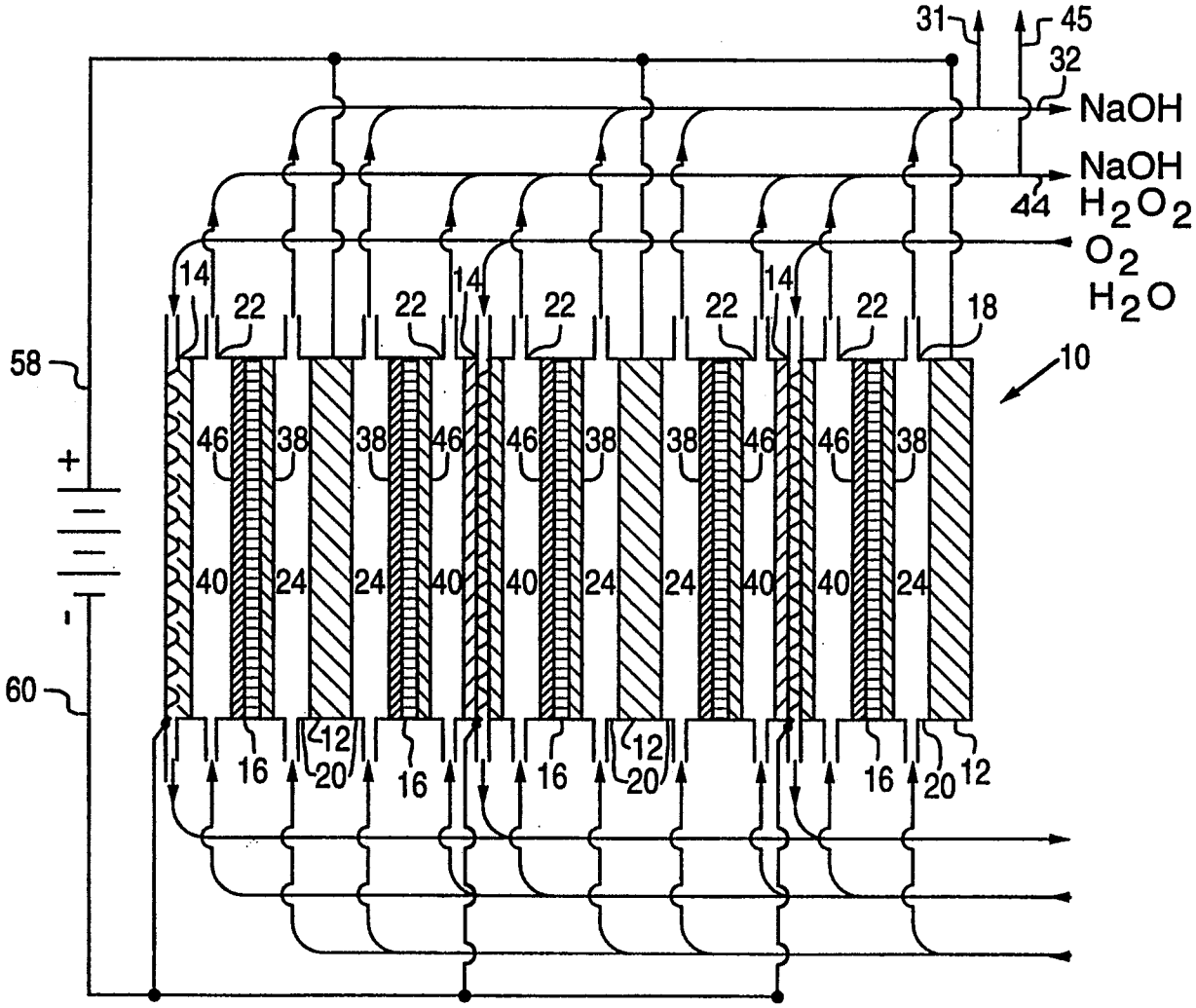
FIG. 2 is a diagrammatic drawing showing apparatus for producing hydrogen peroxide utilizing a plurality of electrolytic cells in the monopolar arrangement having two-sided anodes and two-sided cathodes forming anode and cathode compartments on either side of each with alkaline aqueous anolyte and alkaline aqueous catholyte therein separated by bipolar membranes between the alternating anodes and cathodes.

In FIG. 2, there is generally shown a monopolar cell apparatus 10 for producing hydrogen peroxide in a sodium hydroxide solution which includes a plurality of anodes 12 alternating between a plurality of cathodes 14, and a plurality of bipolar membranes 16 disposed therebetween with anion selective surfaces 38 facing the anodes 12 and with cation selective surfaces 46 facing the cathodes 14, all within an outside shell, or casing, 18 to form anode compartments 20 and cathode compartments 22.

In FIG. 2 there are shown two two-sided anodes and one one-sided anode, two two-sided cathodes and one one-sided cathode, and five bipolar membranes resulting in five anode compartments 20 containing anolyte 24 and in five cathode compartments 22 containing catholyte 40. The two one-sided electrodes are located at the two ends of the alternating anodes cathodes membranes. However, the number of anodes cathodes membranes may be decreased to the case shown in FIG. 1, or may be increased between the end electrodes to any number which is compatible with the practical dimensional and/or structural limitations imposed.

It is to be appreciated that although a rectangular configuration of the apparatus is illustrated in FIG. 2, the actual shape of the anodes/cathodes membranes and overall multi-electrode apparatus may be of any suitable shape which provides a relationship between the anodes 12 cathodes 14 and bipolar membranes 16 as depicted in the schematic FIG. 2. Further, the multi-electrode apparatus shown in FIG. 2 can use a similar arrangement of anolyte, catholyte, gas, and other lines and equipment as depicted in FIG. 1 to serve as an illustrative flow diagram for the method of the present invention. Thus, the description given above with reference to FIG. 1 for anolyte, catholyte and gas flows in a single anode/cathode membrane series plus the described reactions given above also describe the same for the plurality of anodes cathodes and bipolar membranes as shown in FIG. 2; however, the two-sided gas-diffusion cathodes and the electrical connections depicted in FIG. 2 are further explained in the following.

The two two-sided cathodes shown in FIG. 2 comprise two planar members on either side of a chamber like 52 in FIG. 1 to which oxygen or oxygen containing gas is introduced. The two planar members are gas-diffusion cathodes typically made of carbon according to the art, and are electrically connected by a suitable means; for example, in FIG. 2 the depiction of the two-sided cathodes suggests the use of corrugated electroconductive material such as thin nickel metal sheet or expanded metal sheet not only serving to electrically connect the two gas diffusion cathodes but also providing structural support.

The monopolar multi-electrode cell apparatus consists of a plurality of anodes and cathodes which are electrically connected in parallel as shown in FIG. 2 by separate electrical lines to anodes 12, and by separate electrical lines to cathodes 14; then the electrical lines of the anodes are connected together via electrical line 58 to an external power supply 62, and the electrical lines of the cathodes are connected together via electrical line 60 to the external power supply 62. Further, several monopolar multi-electrode cells can be electrically connected together in series with electrical interconnections between the anodes and cathodes of adjacent cells, and the two end cells electrically connected to an external power supply such as 62 in FIG. 2; one end cell having anodes 12 connected to the external power supply via an electrical line similar to 58, and the other end cell having cathodes 14 connected to the external power supply via an electrical line similar to 60.

Figure 3:
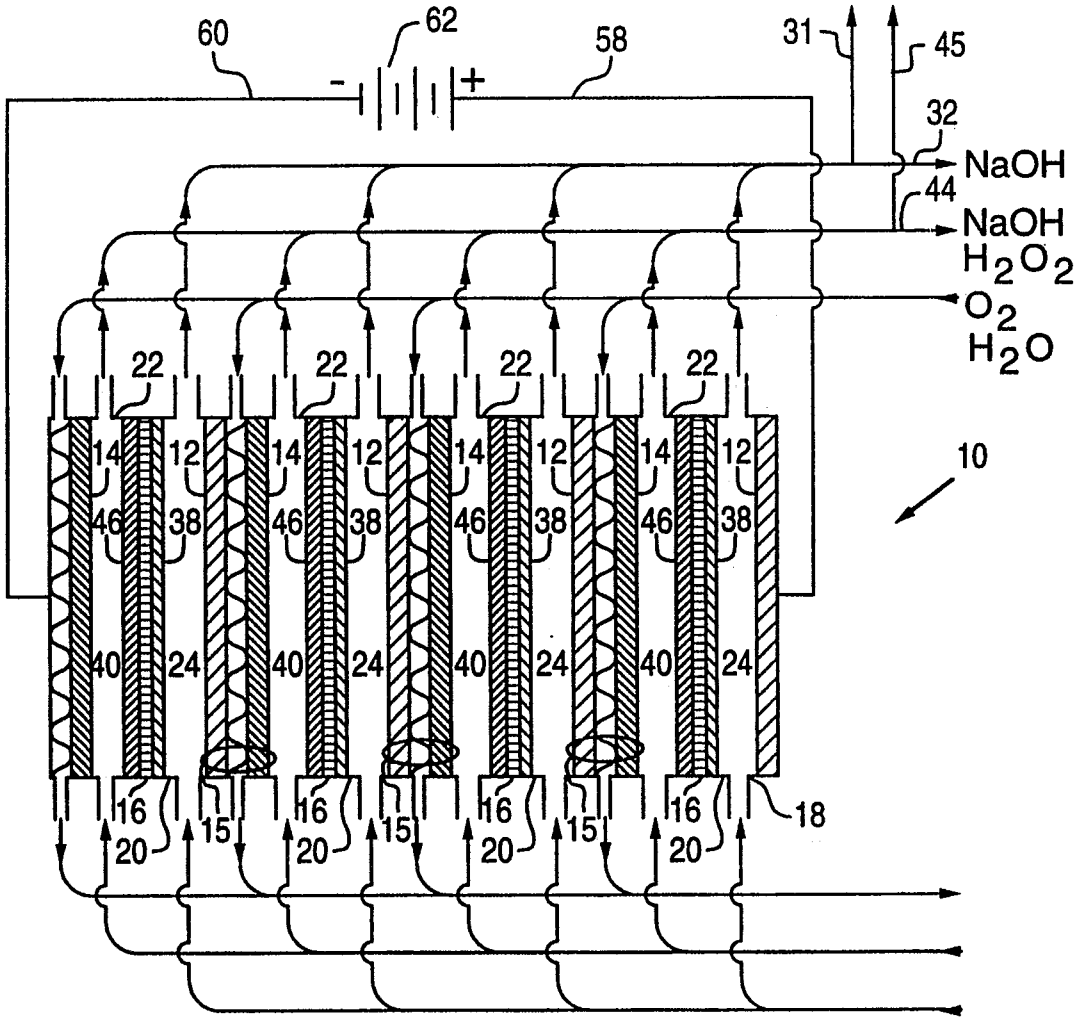
FIG. 3 is a diagrammatic drawing showing apparatus for producing hydrogen peroxide utilizing a plurality of electrolytic cells in the bipolar arrangement having bipolar electrode elements comprised of an anode surface electrically connected to the gas-diffusion cathode surface, forming anode and cathode compartments on either side of each with alkaline aqueous anolyte and alkaline aqueous catholyte therein separated by bipolar membranes between the bipolar electrode elements.

In FIG. 3, there is generally shown an alternative multi-electrode bipolar cell apparatus 10 for producing hydrogen peroxide in a sodium hydroxide solution which generally includes a plurality of bipolar electrodes comprising anode surfaces 12 and cathode surfaces 14, and a plurality of bipolar membranes 16 disposed therebetween with anion selective surfaces 38 facing the anode surfaces 12 and with cation selective surfaces 46 facing the cathode surfaces 14, all within an outside shell, or casing, 18 to form anode compartments 20 and cathode compartments 22.

In FIG. 3, there are shown three complete bipolar electrodes, one cathode, one anode, and four bipolar membranes resulting in four anode compartments 20 containing anolyte 24 and in four cathode compartments 22 containing catholyte 40. The single cathode and the single anode are located at the two ends of the alternating bipolar-electrodes and bipolar-membranes. However, the number of bipolar-electrodes bipolar-membranes may be decreased to the case shown in FIG. 1, or may be increased between the end electrodes to any number which is compatible with the practical dimensional and/or structural limitations imposed.

It is to be appreciated that although a rectangular configuration of the apparatus is illustrated in FIG. 3, the actual shape of the electrodes membranes and overall cell system may be of any suitable shape which provides a relationship between the anode surfaces 12 cathode surfaces 14 and bipolar membranes 16 as depicted in the schematic FIG. 3. Further, the cell shown in FIG. 3 can be use a similar arrangement of anolyte, catholyte, gas, and other lines and equipment as depicted in FIG. 1 to serve as an illustrative flow diagram for the method of the present invention. Thus, the description given above with reference to FIG. 1 for anolyte, catholyte and gas flows in a single anode cathode membrane series plus the described reactions given above also describe the same for the plurality of anode surfaces cathode surfaces and bipolar membranes as shown in FIG. 3; however, the bipolar electrodes and the electrical connections depicted in FIG. 3 are further explained in the following.

The two bipolar electrodes shown in FIG. 3 comprise two planar members on either side of a chamber like 52 in FIG. 1 to which oxygen or oxygen containing gas is introduced. One of the planar members is a gas-diffusion cathode typically made of carbon according to the art, and is electrically connected by a suitable means to the other planar member which is an impervious anode surface; for example, in FIG. 3, the depiction of the bipolar electrodes suggests the use of corrugated electroconductive material such as thin nickel metal sheet to form an impervious anode surface which also serves to support a gas-diffusion cathode on hollow gas spaces and to provide electrical connection between the anode surface and the gas-diffusion cathode surface.

The bipolar cell apparatus consists of a plurality of anode surfaces and cathode surfaces which are electrically connected in series. In FIG. 3, the anode and cathode surfaces of each bipolar electrode are electrically connected in series to each other by means of the electrode structure as exemplified in the foregoing description. The single end anode is connected via electrical line 58 to an external power supply 62, and the single end cathode is connected via electrical line 60 to the external power supply 62. Further, several bipolar cells can be electrically connected together in parallel with electrical connections between the end anodes of each cell and an external power supply such as 62 in FIG. 3 via an electrical line similar to 58, with electrical connections between the end cathodes of each cell and an external power supply via an electrical line similar to 60.

When several cells according to the invention are connected together, the use of bipolar cells can result in savings in power consumption compared to the use of monopolar cells. The electrical interconnections between anodes and cathodes in the bipolar cells are very short compared to typically practical interconnections between anodes and cathodes of adjacent monopolar cells. Shorter interconnections between anodes and cathodes reduce resistive losses of electrical energy.

Bipolar electrolyzers can be expensive to build, especially when the anode and cathode materials are different. In the present invention, the capability of using alkaline electrolyte in both the anode and the cathode compartments allows the use of a material such as nickel which is suitable as an anode surface and which is also compatible as a support and conductive material to the gas diffusion cathode. Thus, a bipolar electrolyzer can be made more inexpensively for the present invention than for an electrolytic cell employing acidic anolyte. Subsequently, the bipolar electrolyzer design contributes to a lower operating cost by reducing losses of electrical energy.

The following examples are presented by way of illustration only, and are not to be considered limiting to the present invention.

EXAMPLE 1

A commercial small scale electrolytic cell is arranged in accordance to the schematic diagram shown in FIG. 1. The electrolytic cell is the MP cell model (multi-purpose cell) obtained from Electrocell AB of Sweden through ElectroSynthesis Company of Buffalo, N.Y., U.S.A. The MP cell is made up of a series of non-conductive, plastic spacers, 6 millimeters thick, with rectangular cut out centers and fitted with rigid plastic meshes on either side of the cut out centers. A total of eight (8) ports are drilled in the spacers; four above the cut out centers and four below. The center cut out of each spacer is connected with one upper port and one lower port through slots which widen into collection/-distribution chambers above/below the center cut out. Different spacers are connected to different pairs of ports and so can be arranged in a sandwich formation (plate and frame filter or plate heat exchanger style) for up to four streams in and four streams out of the cell.

Electrodes for the MP cell are thin plates held between the non-conductive spacers with gaskets for sealing. The electrode plates are cut from larger plates such that tabs extend outside the spacers for electrical connections to a power-supply.

Similarly, a membrane or diaphragm is held between spacers and sealed with gaskets as required.

A gas diffusion electrode is constructed of a metal plate with a rectangular center cut out which is also grooved all around its edge to provide a lip or seat for the porous gas diffusion material(s). The gas diffusion electrode material is held on the grooved lip of the center cut out by a "picture" frame of the same metal plate. The complete gas diffusion electrode is held between spacers as described above and gaskets are used to seal the assembly. Gas is introduced to the spacer on the back side of the gas diffusion electrode and excess gas can pass through an outlet port of the cell.

The cell assembly of spacers, electrodes, membrane(s), and gaskets is sandwiched between two rigid end plates which are tightened together using tie bolts. The procured cell has end plates constructed of steel plates but having TEFLON liners for corrosion resistance. The spacers are PVDF plastic. The gaskets are EPDM rubber.

The open or active area in the center cut outs of the spacers is measured as $$0.099\ \text{m} \times 0.098\ \text{m} = 0.0097\ \text{m}^2.$$

In this first example, the anode is a nickel plate obtained from Electrocell AB (Sweden); the gas diffusion cathode assembly is made of a nickel plate (Sweden) with an ESN-AC uncatalyzed gas diffusion electrode, air cathode, of Black Pearls 2000 carbon, with nickel screen collector (Canada); and the bipolar membrane is a two layer membrane with an interfacial bonding agent of chromium oxide, and manufactured by WSI (U.S.A.).

The cell is energized using a Hewlett-Packard power supply capable of 25 amperes output at up to 20 volts. The cell is operated at a current density of 1.0 kiloampere per square meter for a current requirement of $$0.0097 \times 1 \times 1000 = 9.7\ \text{amperes}.$$

An aqueous sodium hydroxide solution of 5% w/w NaOH concentration is circulated through the anode chamber at a volumetric flowrate of 8.5 milli liters per minute feeding into the cell.

Oxygen gas is introduced to the gas-diffusion cathode at approximately 0.010–0.015 bar gauge and a volumetric feed flowrate to the cell of 200 milli liters per minute. Excess oxygen gas is allowed to exit to atmosphere.

An aqueous sodium hydroxide solution of 5% w/w NaOH concentration is fed to the cathode chamber at a volumetric flowrate of 1.5 milli liter per minute feeding into the cell. The outlet flow of catholyte from the cell is collected as product solution and was not recirculated through the cell. The product catholyte solution is tested for hydrogen peroxide concentration until steady state conditions are achieved as indicated by a constant concentration of hydrogen peroxide at 3.1% w/w $H_2O_2$. The mass flowrate of catholyte product solution is determined at steady state and the production rate of hydrogen peroxide is calculated. The result is a production rate of hydrogen peroxide of approximately 3 grams per hour or an efficiency of 48.8%. The resulting molar ratio of sodium hydroxide to hydrogen peroxide is 1.325.

The measured cell voltage is 4.45 volts.

EXAMPLE II

Example I is repeated with the exceptions that a bipolar membrane made by Aquatech (U.S.A.) is used; this is a two layer composite membrane with an organic interfacial bonding agent. Steady state is achieved at a hydrogen peroxide concentration of 5.4% w/w. The resulting hydrogen peroxide production rate is 5.3 grams per hour or an efficiency of 86.1% and the molar caustic:peroxide ratio was 0.75.

Any and all modifications, variations or equivalent methods and arrangements which may occur to those skilled in the art should be considered to be within the scope of the invention as defined in the appended claims.

What is claimed is:

1. A method for producing hydrogen peroxide comprising the steps of:
   (a) passing an alkaline aqueous anolyte between an alkali resistant anode and an anion selective surface of a bipolar membrane;
   (b) passing an alkaline aqueous catholyte between a cation selective surface of the bipolar membrane and a first surface on a gas-diffusion cathode;
   (c) introducing oxygen-containing gas to a second surface on said gas-diffusion cathode;
   (d) connecting said alkali resistant anode and said gas-diffusion cathode with an external power supply for causing,
      (i) the oxygen to be reduced at said diffusion cathode to produce $O_2H-$ ions within said alkaline aqueous catholyte,
      (ii) the hydroxyl OH− ions in said alkaline aqueous anolyte to be oxidized to produce oxygen, water and electrons within said alkaline aqueous anolyte,
      (iii) the water in said bipolar membrane to be dissociated into hydrogen ions H+ and hydroxyl OH− ions while the dissociated water in said bipolar membrane is replenished by a migration of water from the aqueous electrolytes,
      (iv) the dissociation produced OH− ions, to move through the anion selective surface of said bipolar membrane to the alkaline aqueous anolyte whereupon said OH− ions maintain electroneutrality by replacing anodically oxidized OH− ions of said alkaline aqueous anolyte, and
      (v) the dissociation produced hydrogen ions H+, to move through the cation selective surface of said bipolar membrane to the alkaline aqueous catholyte whereupon said hydrogen ions H+ react with the cathodically produced $HO_2-$ ions to produce hydrogen peroxide within said alkaline aqueous catholyte.

2. A method for producing hydrogen peroxide comprising the steps of:
   (a) introducing an alkaline aqueous anolyte between an alkali resistant anode and an anion selective surface of a bipolar membrane;
   (b) introducing an alkaline aqueous catholyte between a cation selective surface of the bipolar membrane and a first surface on a gas-diffusion cathode, said bipolar membrane separating said alkaline aqueous anolyte and said alkaline aqueous catholyte;
   (c) introducing oxygen-containing gas to a second surface on said gas-diffusion cathode;
   (d) connecting said alkali resistant anode and said gas-diffusion cathode with an external power supply for causing,
      (i) the oxygen to be reduced at said diffusion cathode to produce $O_2H-$ ions within said alkaline aqueous catholyte,
      (ii) the hydroxyl OH− ions in said alkaline aqueous anolyte to be oxidized to produce oxygen, water and electrons within said alkaline aqueous anolyte,
      (iii) the water in said bipolar membrane to be dissociated into hydrogen ions H+ and hydroxyl OH− ions while the dissociated water in said bipolar membrane is replenished by a migration of water from the aqueous electrolytes,
      (iv) the dissociation produced OH− ions, to move through the anion selective surface of said bipolar membrane to the alkaline aqueous anolyte whereupon said OH− ions maintain electroneutrality by replacing anodically oxidized OH− ions of said alkaline aqueous anolyte, and
      (v) the dissociation produced hydrogen ions H+, to move through the cation selective surface of said bipolar membrane to the alkaline aqueous catholyte whereupon said hydrogen ions H+ react with the cathodically produced $HO_2-$ ions to produce hydrogen peroxide within the alkaline aqueous catholyte; and
   (e) withdrawing alkaline aqueous catholyte and hydrogen peroxide from between the bipolar membrane cation selective surface and the gas-diffusion cathode first surface.

3. A method for producing hydrogen peroxide comprising the steps of:
   (a) passing a sodium hydroxide solution anolyte between an alkali resistant anode and an anion selective surface of a bipolar membrane;
   (b) passing a sodium hydroxide solution catholyte between a cation selective surface of the bipolar membrane and a first surface on a gas-diffusion cathode;
   (c) introducing oxygen-containing gas to a second surface on said gas-diffusion cathode;
   (d) connecting said alkali resistant anode and said gas-diffusion cathode with an external power supply for causing, (i) the oxygen to be reduced at said diffusion cathode to produce $O_2H-$ ions within said sodium hydroxide solution catholyte, (ii) the hydroxyl OH− ions in said sodium hydroxide solution anolyte to be oxidized to produce oxygen, water and electrons within said sodium hydroxide solution anolyte, (iii) the water in said bipolar membrane to be dissociated into hydrogen ions H+1 and hydroxyl OH− ions while the dissociated water in said bipolar membrane is replenished by a migration of water from the aqueous electrolytes, (iv) the dissociation produced OH− ions, to move through the anion selective surface of said bipolar membrane to the sodium hydroxide solution anolyte whereupon said OH− ions maintain electroneutrality by replacing anodically oxidized OH− ions of said sodium hydroxide solution anolyte, and (v) the dissociation produced hydrogen ions H+1, to move through the cation selective surface of said bipolar membrane to the sodium hydroxide solution catholyte whereupon said hydrogen ions H+1 react with the cathodically produced $HO_2-$ ions to produce hydrogen peroxide within said sodium hydroxide solution catholyte; and (e) withdrawing sodium hydroxide solution catholyte and hydrogen peroxide from between the bipolar membrane cation selective surface and the gas-diffusion cathode first surface.

4. The method of claim 3, wherein the sodium hydroxide solution catholyte is circulated between the cation selective surface of the bipolar membrane and the gas-diffusion cathode first surface until said sodium hydroxide solution catholyte has a sodium ion to hydrogen peroxide ratio of less than about 2.0 before withdrawing said sodium hydroxide solution catholyte and hydrogen peroxide as product.

5. The method of claim 3, wherein the sodium hydroxide solution catholyte is circulated between the cation selective surface of the bipolar membrane and the gas-diffusion cathode first surface until said sodium hydroxide solution catholyte has a sodium ion to hydrogen peroxide ratio of less than 1.0 before withdrawing said sodium hydroxide solution catholyte and hydrogen peroxide as product.

6. The method of claim 3, wherein the sodium hydroxide solution catholyte is circulated between the cation selective surface of the bipolar membrane and the gas-diffusion cathode first surface until said sodium hydroxide solution comprises approximately 5% by weight hydrogen peroxide before withdrawing said sodium hydroxide solution catholyte and hydrogen peroxide as product.

7. A method for producing hydrogen peroxide comprising the steps of:

(a) passing a sodium hydroxide solution anolyte between a nickel anode and an anion selective surface of a bipolar membrane;

(b) passing a sodium hydroxide solution catholyte between a cation selective surface of the bipolar membrane and a first surface on a gas-diffusion cathode;

(c) introducing oxygen-containing gas to a second surface on said gas-diffusion cathode;

(d) connecting said alkali resistant anode and said gas-diffusion cathode with an external power supply for causing, (i) the oxygen to be reduced at said diffusion cathode to produce $O_2H-$ ions within said sodium hydroxide solution catholyte, (ii) the hydroxyl OH− ions in said sodium hydroxide solution anolyte to be oxidized to produce oxygen, water and electrons within said sodium hydroxide solution anolyte, (iii) the water in said bipolar membrane to be dissociated into hydrogen ions H+ and hydroxyl OH− ions while the dissociated water in said bipolar membrane is replenished by a migration of water from the aqueous electrolytes, (iv) the dissociation produced OH− ions, to move through the anion selective surface of said bipolar membrane to the sodium hydroxide solution anolyte whereupon said OH− ions maintain electroneutrality by replacing anodically oxidized OH− ions of said sodium hydroxide solution anolyte, and (v) the dissociation produced hydrogen ions H+, to move through the cation selective surface of said bipolar membrane to the sodium hydroxide solution catholyte whereupon said hydrogen ions H+ react with the cathodically produced OH− and $HO_2-$ ions to produce water and hydrogen peroxide within said sodium hydroxide solution catholyte; and (e) circulating the sodium hydroxide solution catholyte between the cation selective surface of the bipolar membrane and the gas-diffusion cathode first surface until said sodium hydroxide solution comprises approximately 5% by weight hydrogen peroxide with a ratio of sodium ions to hydrogen peroxide of less than 1.0; and (f) withdrawing a portion of said sodium hydroxide solution comprising approximately 5% by weight hydrogen peroxide as product from the circulating sodium hydroxide solution catholyte.

* * * * *